US008607411B2

(12) United States Patent
Dominguez et al.

(10) Patent No.: US 8,607,411 B2
(45) Date of Patent: Dec. 17, 2013

(54) COMBINATION OF CARPET-CLEANING MACHINE AND PLATFORM FOR TRANSPORTING THE MACHINE

(75) Inventors: Arthur L. Dominguez, New Oxford, PA (US); John Kwasniewicz, Eagle, WI (US); Geoffrey B. Rench, Racine, WI (US); Jeffrey T. Borowski, Cudahy, WI (US)

(73) Assignee: Racine Industries, Inc., Racine, WI (US)

( * ) Notice: Subject to any disclaimer, the term of this patent is extended or adjusted under 35 U.S.C. 154(b) by 477 days.

(21) Appl. No.: 12/828,504

(22) Filed: Jul. 1, 2010

(65) Prior Publication Data

US 2011/0000037 A1 Jan. 6, 2011

Related U.S. Application Data

(60) Provisional application No. 61/222,399, filed on Jul. 1, 2009.

(51) Int. Cl.
*A47L 5/10* (2006.01)
*A47L 5/26* (2006.01)

(52) U.S. Cl.
USPC ..... 15/392; 15/353; 15/410; 15/337; 15/262; 15/393

(58) Field of Classification Search
USPC ..... 15/320, 337, DIG. 3, 392, 353, 327.2, 15/393, 398, 4, 246.2, 246.4, 410; 404/19; 55/DIG. 3
See application file for complete search history.

(56) References Cited

U.S. PATENT DOCUMENTS

| | | | |
|---|---|---|---|
| 3,651,536 | A | 3/1972 | Bolzan, Jr. et al. |
| 3,778,863 | A | 12/1973 | Westergren et al. |
| 3,813,054 | A | 5/1974 | Klingspor |
| 3,869,265 | A | 3/1975 | Wolter et al. |
| 3,913,190 | A | 10/1975 | Savageau et al. |
| 4,222,145 | A | 9/1980 | Lowder |
| 4,343,420 | A | 8/1982 | Scott |
| 4,446,594 | A | 5/1984 | Watanabe et al. |

(Continued)

OTHER PUBLICATIONS

Excerpts of International Search Report and Written Opinion (PCT/US2010/01875), 6 pages, Date: Aug. 30, 2010.

*Primary Examiner* — Chi Q Nguyen
(74) *Attorney, Agent, or Firm* — Jansson Munger McKinley & Shape Ltd.

(57) ABSTRACT

In a platform-carried carpet-cleaning machine for facilitating transport of the machine, the platform including a machine-supporting base having upper surface extending between an open entry-end and a closed back-end, the upper surface having an entry portion sloping at no more than about 5° with respect to horizontal such that the machine can be driven on and off the platform with application of about the same amount of user force as during carpet-cleaning operations. Inner surfaces of first and second platform sidewalls both include protrusions frictionally engaging the machine side panels and configured to sandwich the machine therebetween to prevent lateral movement of the machine on the platform. A pair of wheels is mounted with respect to the base for rolling the machine on the platform across a floor, each wheel being secured to its corresponding sidewall by an axle which extends therethrough and is molded in place through the sidewalls to facilitate assembly of the platform. At least one skid-resisting projection extends from the lower surface to hold the platform from unintended backward rolling when the machine is driven onto the platform.

29 Claims, 10 Drawing Sheets

(56) References Cited

U.S. PATENT DOCUMENTS

| | | | | | |
|---|---|---|---|---|---|
| 4,527,302 | A | | 7/1985 | Maurer et al. | |
| 4,534,082 | A | | 8/1985 | Piquin | |
| 4,592,764 | A | | 6/1986 | Ikezaki et al. | |
| 4,615,070 | A | | 10/1986 | Frederick et al. | |
| 4,658,465 | A | | 4/1987 | Keane et al. | |
| 4,827,564 | A | | 5/1989 | Brown | |
| 4,845,793 | A | | 7/1989 | Meyer | |
| 4,858,271 | A | | 8/1989 | Berfield et al. | |
| 4,929,345 | A | | 5/1990 | Meador | |
| 4,945,603 | A | | 8/1990 | Herron, Jr. | |
| 4,955,106 | A | | 9/1990 | Stein et al. | |
| 4,989,291 | A | | 2/1991 | Parent | |
| 5,016,315 | A | | 5/1991 | Bledsoe et al. | |
| 5,095,579 | A | | 3/1992 | Becker | |
| 5,107,567 | A | | 4/1992 | Ferrari et al. | |
| 5,113,546 | A | | 5/1992 | Parent | |
| 5,131,114 | A | | 7/1992 | Sunagawa et al. | |
| 5,134,750 | A | | 8/1992 | King et al. | |
| 5,144,716 | A | | 9/1992 | Watanabe et al. | |
| 5,263,223 | A | | 11/1993 | Fiegel et al. | |
| 5,331,715 | A | | 7/1994 | Johnson et al. | |
| 5,373,606 | A | | 12/1994 | Bosyj et al. | |
| 5,467,502 | A | | 11/1995 | Johnson et al. | |
| 5,479,676 | A | | 1/1996 | Martin et al. | |
| 5,515,573 | A | | 5/1996 | Frey | |
| 5,524,321 | A | | 6/1996 | Weaver et al. | |
| 5,528,794 | A | | 6/1996 | Tomasiak | |
| 5,604,953 | A | | 2/1997 | Castwall et al. | |
| 5,634,237 | A | | 6/1997 | Paranjpe | |
| 5,640,740 | A | | 6/1997 | Martin et al. | |
| 5,655,254 | A | * | 8/1997 | Bores et al. | 15/320 |
| 5,755,006 | A | | 5/1998 | Botting et al. | |
| 5,761,764 | A | * | 6/1998 | Fiegel et al. | 15/353 |
| 5,781,962 | A | * | 7/1998 | Fiegel et al. | 15/392 |
| 5,819,364 | A | * | 10/1998 | Sham | 15/320 |
| 5,841,259 | A | | 11/1998 | Kim et al. | |
| 5,887,815 | A | | 3/1999 | Pierce | |
| 5,924,165 | A | | 7/1999 | Gierer et al. | |
| 5,937,476 | A | | 8/1999 | Kim | |
| 5,959,423 | A | | 9/1999 | Nakanishi et al. | |
| 5,974,622 | A | | 11/1999 | Louis et al. | |
| 5,991,970 | A | | 11/1999 | Jailor et al. | |
| 5,996,170 | A | | 12/1999 | Gierer et al. | |
| 6,058,558 | A | | 5/2000 | Kim | |
| 6,076,226 | A | | 6/2000 | Reed | |
| 6,081,963 | A | | 7/2000 | Jailor et al. | |
| 6,092,261 | A | | 7/2000 | Boomgaarden | |
| 6,115,878 | A | * | 9/2000 | McLaughlin et al. | 15/262 |
| 6,131,238 | A | | 10/2000 | Weber et al. | |
| 6,170,118 | B1 | | 1/2001 | McIntyre et al. | |
| 6,206,980 | B1 | | 3/2001 | Robinson | |
| 6,260,233 | B1 | | 7/2001 | Wareham et al. | |
| 6,339,861 | B1 | | 1/2002 | Snyder | |
| 6,349,808 | B1 | | 2/2002 | Bryant | |
| 6,370,453 | B2 | | 4/2002 | Sommer | |
| 6,374,452 | B1 | | 4/2002 | Essex et al. | |
| 6,382,241 | B1 | | 5/2002 | Setrum | |
| 6,385,809 | B1 | | 5/2002 | Martin et al. | |
| 6,389,641 | B1 | | 5/2002 | Boomgaarden et al. | |
| 6,428,590 | B1 | | 8/2002 | Lehman et al. | |
| 6,446,302 | B1 | | 9/2002 | Kasper et al. | |
| 6,446,303 | B1 | | 9/2002 | Paterson et al. | |
| 6,484,352 | B2 | | 11/2002 | Huebsch et al. | |
| 6,488,744 | B2 | | 12/2002 | Cartellone | |
| 6,493,612 | B1 | | 12/2002 | Bisset et al. | |
| 6,530,584 | B1 | | 3/2003 | Lucy | |
| 6,536,073 | B2 | | 3/2003 | Uratani et al. | |
| D474,312 | S | | 5/2003 | Stephens et al. | |
| 6,611,989 | B2 | | 9/2003 | Oh et al. | |
| 6,615,447 | B2 | | 9/2003 | Rew | |
| 6,637,067 | B2 | | 10/2003 | Paterson et al. | |
| 6,698,771 | B1 | | 3/2004 | Bergeron | |
| 6,729,631 | B2 | | 5/2004 | Trine et al. | |
| 6,834,412 | B2 | | 12/2004 | Stanovich et al. | |
| 6,836,929 | B2 | | 1/2005 | Kim | |
| 6,941,615 | B2 | | 9/2005 | Shanor et al. | |
| 6,968,587 | B2 | | 11/2005 | Grey | |
| D516,260 | S | | 2/2006 | Chen | |
| 7,022,167 | B2 | | 4/2006 | Hess | |
| 7,039,985 | B2 | | 5/2006 | Hisrich et al. | |
| 7,055,210 | B2 | | 6/2006 | Keppler et al. | |
| 7,100,236 | B1 | | 9/2006 | Ji | |
| 7,165,290 | B2 | | 1/2007 | Martinez et al. | |
| 7,188,388 | B2 | | 3/2007 | Best et al. | |
| 7,191,488 | B2 | | 3/2007 | Jonsson | |
| 7,266,859 | B2 | | 9/2007 | Slone | |
| 7,272,869 | B1 | | 9/2007 | Robinson | |
| 7,325,271 | B2 | | 2/2008 | Paterson et al. | |
| 7,332,005 | B2 | | 2/2008 | Wegelin | |
| 7,350,262 | B2 | | 4/2008 | Scheifele | |
| 7,367,081 | B2 | | 5/2008 | O'Neal | |
| 7,383,612 | B2 | | 6/2008 | Bushey | |
| 7,411,133 | B2 | | 8/2008 | Morgan et al. | |
| 7,416,110 | B2 | | 8/2008 | Campbell | |
| 7,418,762 | B2 | | 9/2008 | Arai et al. | |
| 7,418,764 | B2 | | 9/2008 | Gordon et al. | |
| 7,448,114 | B2 | | 11/2008 | Basham et al. | |
| 7,450,367 | B2 | | 11/2008 | Frank et al. | |
| 7,513,007 | B2 | | 4/2009 | Chernoff | |
| 7,758,279 | B2 | * | 7/2010 | Driscoll | 404/19 |

* cited by examiner

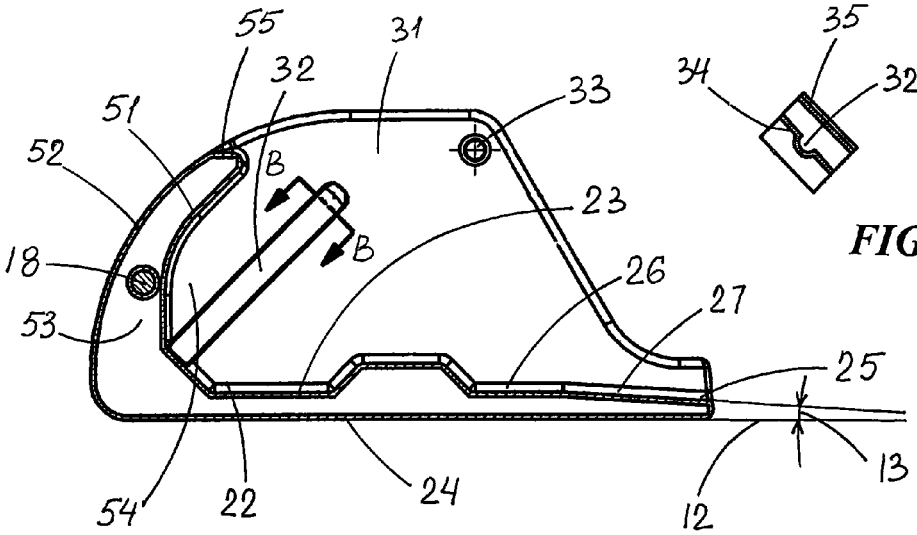
FIG. 7
FIG. 8
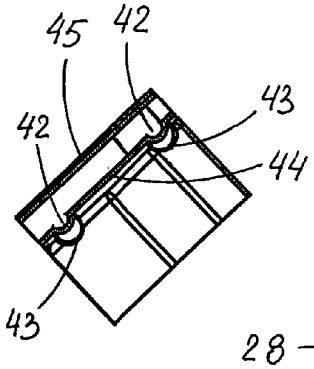
FIG. 10
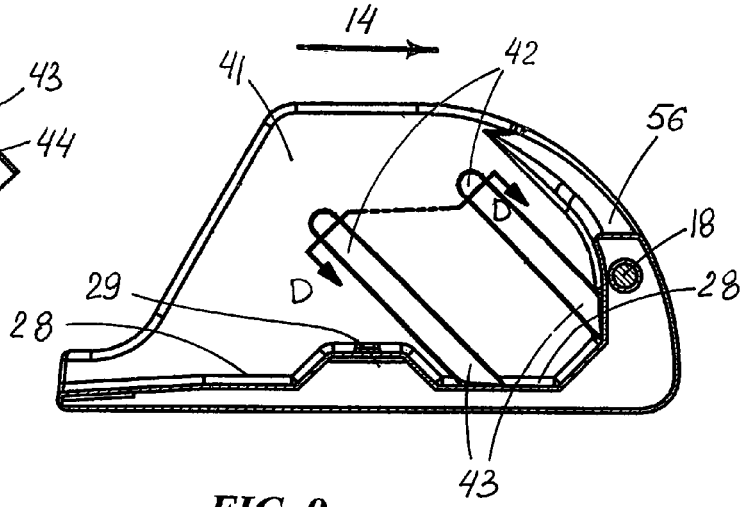
FIG. 9

COMBINATION OF CARPET-CLEANING MACHINE AND PLATFORM FOR TRANSPORTING THE MACHINE

RELATED APPLICATION

This application is based in part on U.S. Provisional Application Ser. No. 61/222,399, filed Jul. 1, 2009, the contents of which are incorporated herein by reference.

FIELD OF THE INVENTION

This invention relates to professional carpet-cleaning machines, particularly to devices for transporting such carpet-cleaning machines.

BACKGROUND OF THE INVENTION

In the carpet-cleaning industry, professional carpet-cleaners use highly effective machines specially designed for performing heavy-duty cleaning. Examples of such machines are disclosed in U.S. Pat. Nos. 5,086,539 and 5,077,862. These machines typically have a substantial weight which may reach or even exceed seventy pounds. While being very heavy, the construction of such machines does not incorporate any wheels for transportation purposes. Rather, these machines move across carpets by rotation of their scrubbing brushes. However, to transport such machines from their storage location or service truck to the carpeting that needs to be cleaned, the machines are loaded on a wheeled platform and rolled thereon to a desired location.

With some types of previous wheeled platforms one had to pick up the machine to load it on its wheeled platform or to take the machine off the platform. Of course, with the machine's substantial weight, such operation may become rather burdensome and even dangerous, especially for smaller persons and women.

One prior wheeled platform disclosed in U.S. Pat. No. 5,755,006 offered a ramp for pulling a very heavy machine on the platform. Such ramp, however, was very steep and still required substantial effort by the user for pulling the machine up on the platform. Considering the machine's heavy weight, such pulling up remained a very hard task. In addition to the physical difficulty in positioning of the machine on such platform, the repetitive application of the substantial pulling force to a machine handle sometimes resulted in damage to the handle.

Furthermore, in performing professional cleaning, the machine often needs to be moved up or down the stairs. With some previous wheeled platforms, the user had to pick up and carry the machine up or down the stairs. This made the transportation along the stairs very difficult.

In summary, there is a need for an improved transport platform allowing easier loading of carpet-cleaning machines on their wheeled platforms and facilitating their transportation, including along the stairs.

OBJECTS OF THE INVENTION

It is an object of the invention to provide an improved combination of a carpet cleaning machine and a transport platform therefor overcoming some of the problems and shortcomings of the prior art, including those referred to above.

Another object of the invention is to provide an improved combination of the machine and the transport platform which allows for easy loading and offloading of the machines on and off the platform.

Another object of the invention is to provide an improved combination of the machine and the transport platform with secure holding of the machine thereon.

Yet another object of the invention is to provide an improved combination of the machine and the transport platform which facilitates transportation of the machine up and down the stairs.

Another object of the invention is to provide an improved combination of the machine and the transport platform which is designed for restrain movement of the machine on the platform.

Another object of the invention is to provide an improved combination of the machine and the transport platform which is designed to substantially avoid deformation of brush bristles of the machine during storage or transportation.

Still another object of the invention is to provide an improved combination of the machine and the transport platform which provides an improved stability in machine movement which facilitates controlling of the machine movement and riding of the machine onto the platform.

How these and other objects are accomplished will become apparent from the following descriptions and the drawings.

SUMMARY OF THE INVENTION

This invention, which will be described in detail below, is an improvement in a platform-carried carpet-cleaning machine for facilitating transport of the machine. The platform is of the type including a machine-supporting base, first and second sidewalls extending upwardly from the base on either side thereof, a back wall extending from a base back-end between the first and second sidewalls, and a pair of wheels mounted with respect to the base for rolling the machine on the platform across a floor. The base has upper and lower surfaces extending between an open entry-end and a closed back-end. The upper surface has a stowing portion extending from the closed back-end to an entry portion.

The inventive platform for carpet-cleaning machines has the upper surface of the entry portion sloping at no more than about 5° with respect to horizontal such that the machine can be driven on and off the platform with application of about the same amount of user force as during carpet-cleaning operations. In some preferred embodiments, the angle is about 3.3°.

The machine has first and second side panels. In highly preferred embodiments, the inner surfaces of the first and second platform sidewalls both include protrusions frictionally engaging the machine side panels and configured to sandwich the machine therebetween to prevent lateral movement of the machine on the platform. The protrusion(s) of the inner surfaces of the platform sidewalls are preferably elongate protrusions extending in a fore-to-aft direction.

In preferred embodiments, the first platform sidewall defines a pin-receiving opening. In such embodiments, the machine includes a securing pin which slides horizontally from the first side panel for engagement of the pin-receiving opening in the platform first sidewall. Such pin-and-opening engagement restrains vertical movement of the sandwiched machine on the platform.

The protrusion(s) from the second platform sidewall preferably extend outwardly from the sidewall progressively more toward the aft end(s) thereof. This facilitates the sandwiching of the machine and pressing of the machine first side panel against the platform first sidewall to secure the pin-and-opening engagement.

An important aspect of this invention is that the pair of wheels have a diameter of about the vertical dimension of the platform in resting position. Each wheel preferably extends alongside a corresponding one of the sidewalls and is preferably secured to its corresponding sidewall by an axle extending through such sidewall. Such wheel dimensioning facilitates movement of the machine on the platform across uneven pavement. Compared to prior transport machines, the greater diameter of the wheels is most beneficial for moving the machine on the platform up and down the stairs.

In preferred embodiments, the platform base, sidewalls and the back wall are integrally molded as a single piece. It is highly preferred that the axle be non-movably molded in place through the sidewalls to facilitate assembly of the platform. Both wheels are preferably supported by the same axle.

The back wall preferably has an undercut shape to conform to the outer back configuration of the machine. The term "undercut," as used herein, means that the back wall has a shape extending up and over the back of the machine. As a result, the outer back configuration of the machine is securely positioned within such formed undercut cavity. It is further preferred that the back wall has an upper edge defining a cutout which receives an outwardly-extending portion of the machine back configuration.

Some preferred embodiments of this invention are used with machines of the type including at least one brush having flexible bristles thereon. In such embodiments, the platform base includes a brush-contact surface. It is highly preferred that a chock extends from the stowing portion of the platform-base upper surface for a sufficient dimension to support the machine such that the brush remains above or at the upper surface. This is desirable in order to prevent significant bending of brush bristles during storage and/or transportation.

The machine preferably has a pair of counter-rotating brushes by which the machine is moved along a floor. The brushes support the machine on the floor and are the means for moving the machine along the floor for cleaning the carpet. For transportation, the machine is positioned on a wheeled platform.

The machine preferably further includes a bottom housing over the brushes. Such bottom housing has first and second side panels and a main body between the panels. A top housing is preferably secured over the bottom housing and the machine is configured such that the top housing is centered over the brushes. In some prior machines, the top housing is not in a true centered position over the brushes. In such cases, the center of gravity is also off center which results in side-to-side movement of the machine. During cleaning operation, such side-to-side movement interferes with controlling of the machine direction such that the entire intended carpet surface be cleaned. The same side-to-side shifting of the machine also interferes with proper positioning of the machine for its entry onto the transport platform. The true centering of the machine minimizes such side-to-side movement during use and facilitates riding of the machine onto the platform.

It is preferred that a handle arm extends upwardly from the main body of the bottom housing and includes an off-set shape to an extent which allows shifting of the center of gravity of the top housing over the center of the path of the brushes. Such handle-arm off-set permits positioning of the top housing over the bottom housing in the true centered orientation.

In some preferred embodiments, at least one skid-resisting projection extends from the lower surface of the base to facilitate holding of the platform from unintended backward rolling during driving of the machine onto the platform. It is preferred that a plurality of spaced skid-resisting projections extend from the lower surface. The skid-resisting projections are preferably rubber pieces secured to the lower surface. The securement may be by a screw engagement or in any other suitable manner.

The improved platform of this invention overcomes the problems described above, and provides important advantages for professional carpet-cleaning services.

BRIEF DESCRIPTION OF THE DRAWINGS

FIG. 7 is a cross-sectional side view of the platform along lines A-A shown in FIG. 5.

FIG. 8 is a fragmentary sectional view along lines B-B shown in FIG. 7 and illustrating protrusions of the first platform sidewall.

FIG. 9 is a cross-sectional side view of the platform along lines C-C shown in FIG. 5.

FIG. 10 is a fragmentary sectional view along lines D-D shown in FIG. 9 and illustrating protrusions of the second platform sidewall.

DETAILED DESCRIPTION OF PREFERRED EMBODIMENTS

Figure 1:
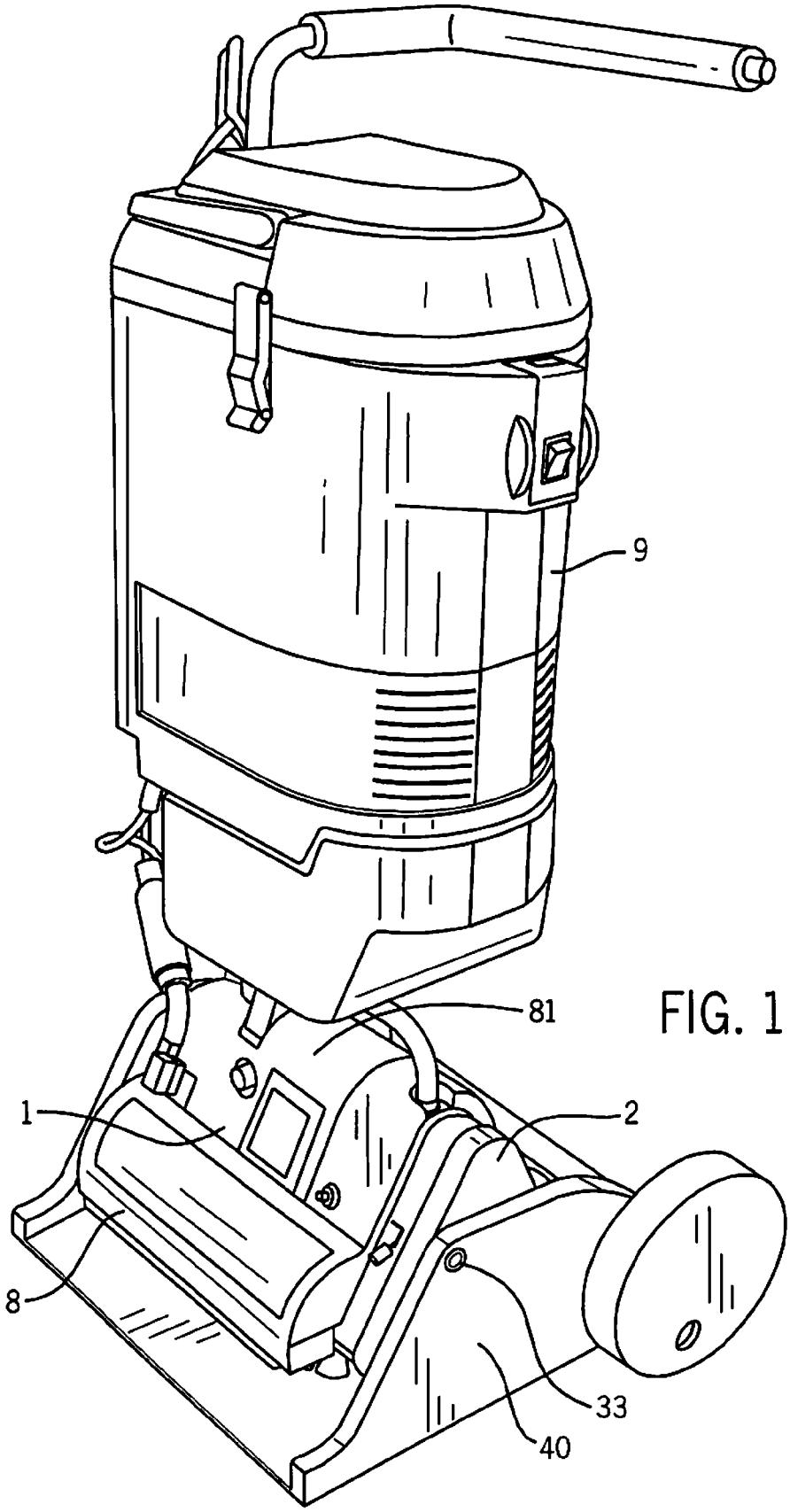
FIG. 1 is a perspective view of a carpet-cleaning machine on an improved transport platform.
Figure 2:
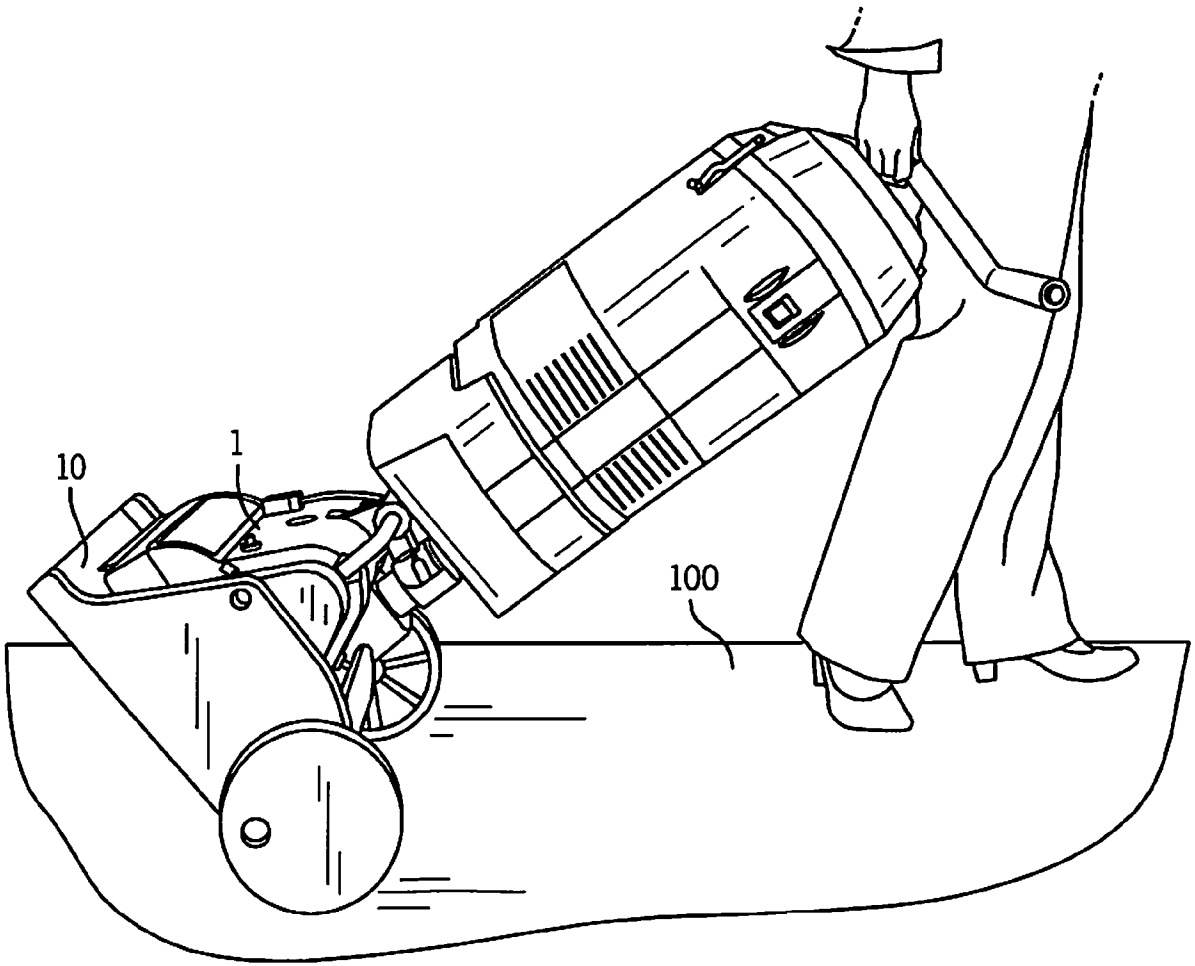
FIG. 2 is a perspective side view showing rolling of the machine on the platform of FIG. 1 across a floor.

The drawings show an improvement in a platform-carried carpet-cleaning machine 1 for facilitating transport of machine 1 as illustrated in FIGS. 1 and 2. FIGS. 3-6 best show that a platform 10 includes a machine-supporting base 20, first and second sidewalls 30 and 40 extending upwardly from base 20 on either side 21 thereof, a back wall 50 extending from a base back-end 22 between first and second sidewalls 30 and 40, and a pair of wheels 60 mounted with respect to base 20 for rolling machine 1 on platform 10 across a floor 100. As shown in FIGS. 7 and 9, base 20 has upper and lower surfaces 23 and 24 extending between an open entry-end 25 and the closed back-end 22. Upper surface 23 has a stowing portion 26 extending from closed back-end 22 to an entry portion 27.

Figure 18:
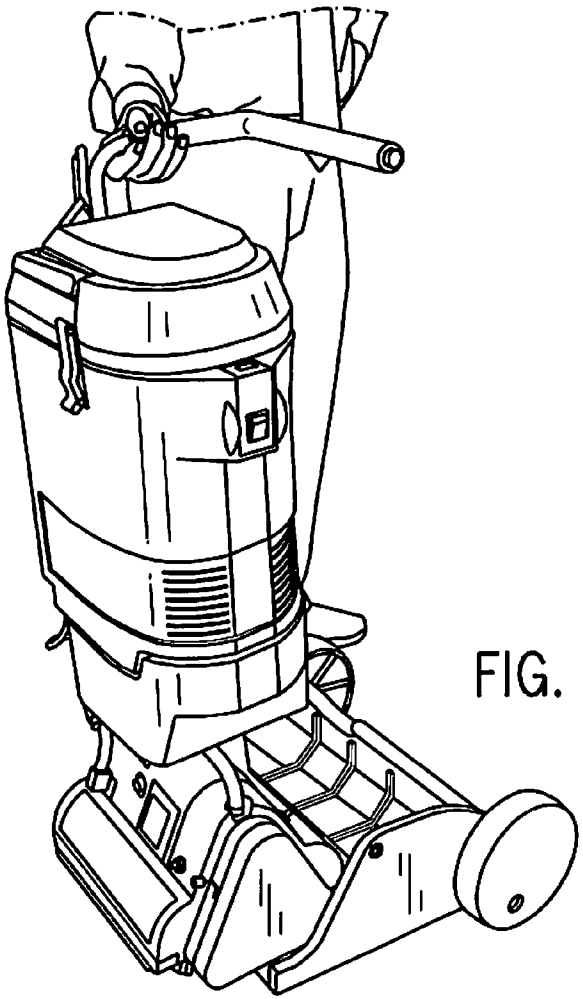
FIG. 18 is a perspective view showing the machine partially on the floor and partially on the platform.
Figure 17:
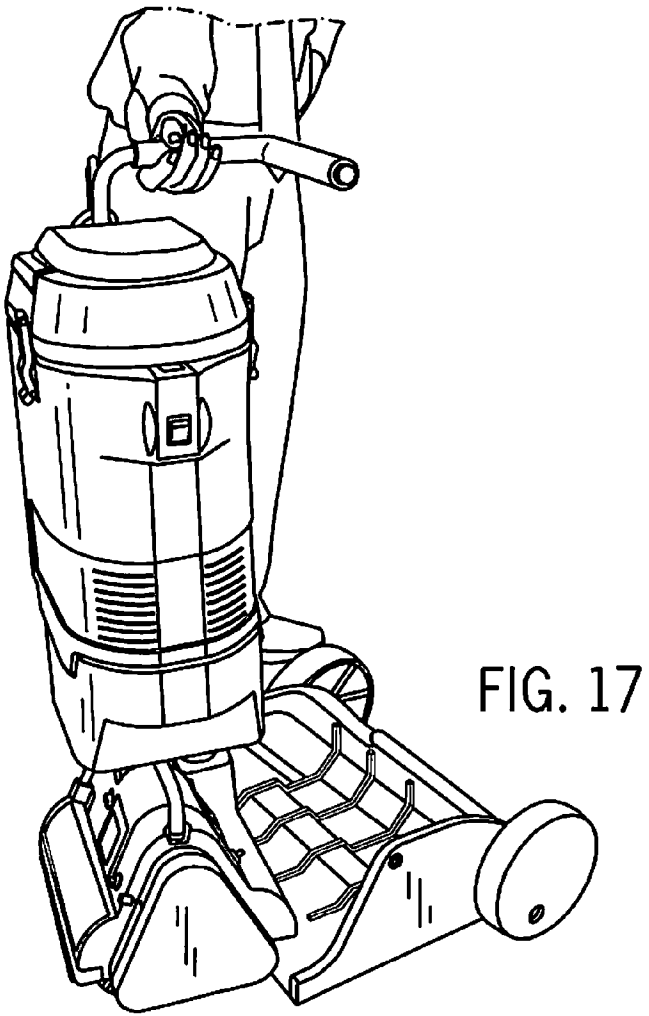
FIG. 17 is a perspective view showing the machine on the floor at the platform entry-end.

FIGS. 7 and 9 best show that upper surface 23 of entry portion 27 slopes at the angle 13 of about 3.3° with respect to horizontal 12 or floor 100. FIGS. 17 and 18 illustrate how this allows machine 1 to be driven easily on and off platform 10 with application of about the same amount of user force as during carpet-cleaning operations.

Figure 14:
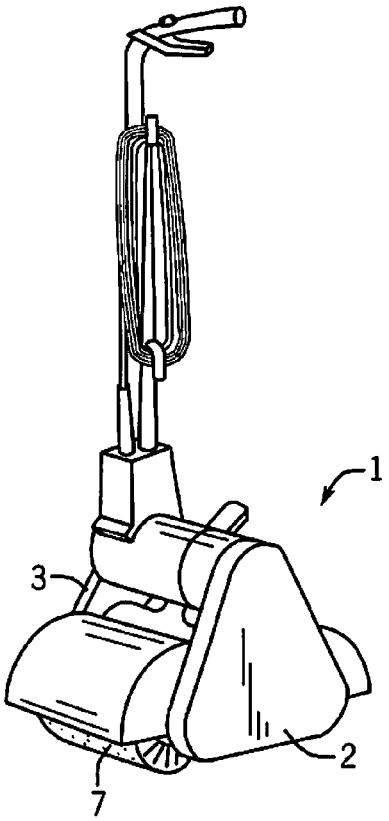
FIG. 14 is a perspective view of the machine from one side.
Figure 15:
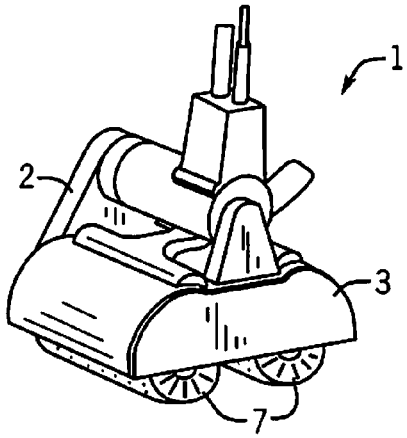
FIG. 15 is a perspective view of the machine from the other side.

Machine 1 has first and second side panels 2 and 3 seen in FIGS. 14 and 15. As best illustrated in FIGS. 7-10, inner surfaces 31 and 41 of first and second platform sidewalls 30 and 40 both include protrusions 32 and 42 frictionally engaging machine side panels 2 and 3. Protrusions 32 and 42 are configured to sandwich machine 1 therebetween to prevent lateral movement of machine 1 on platform 10. FIGS. 7 and 9 also show that protrusions 32 and 42 of inner surfaces 31 and 41 of the platform sidewalls 30 and 40 are elongate protrusions extending in a fore-to-aft direction 14.

Figure 11:
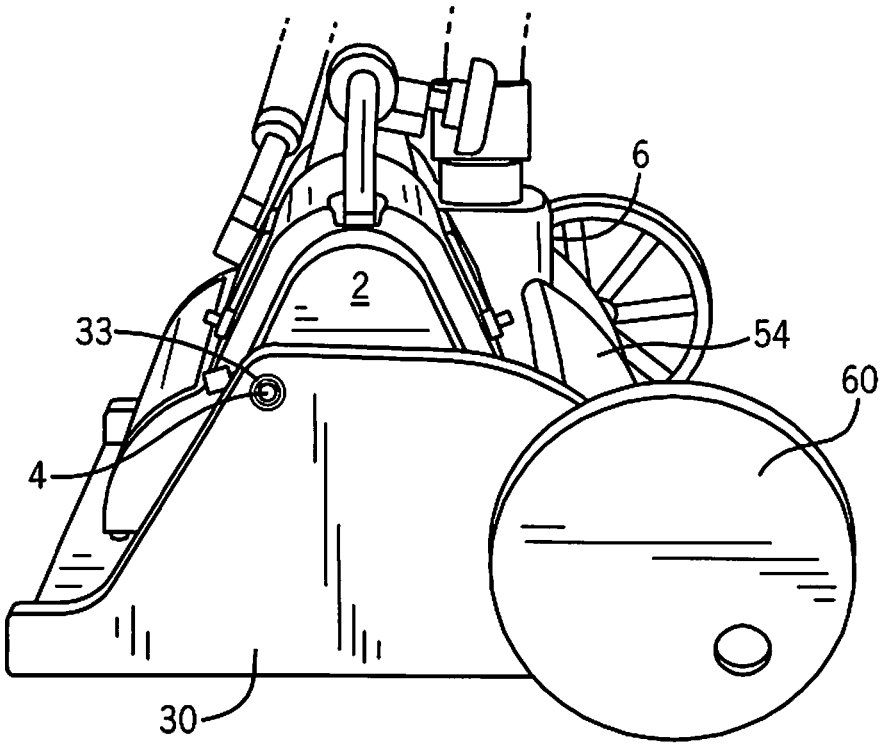
FIG. 11 is a side perspective view of the carpet-cleaning machine on the platform.

FIGS. 1, 2, 8 and 11 show that first platform sidewall 30 defines a pin-receiving opening 33. As best seen in FIG. 11, machine 1 includes a securing pin 4 which slides horizontally from first side panel 2 for engagement of pin-receiving opening 33. Such pin-and-opening engagement restrains vertical movement of sandwiched machine 1 on platform 10.

It is seen in FIG. 10 that protrusions 42 of second platform sidewall 40 extend outwardly from sidewall 40 progressively more toward their aft ends 43. This facilitates the sandwiching of machine 1 and pressing of machine first side panel 2 against platform first sidewall 30 to secure the pin-and-opening engagement.

Figure 3:
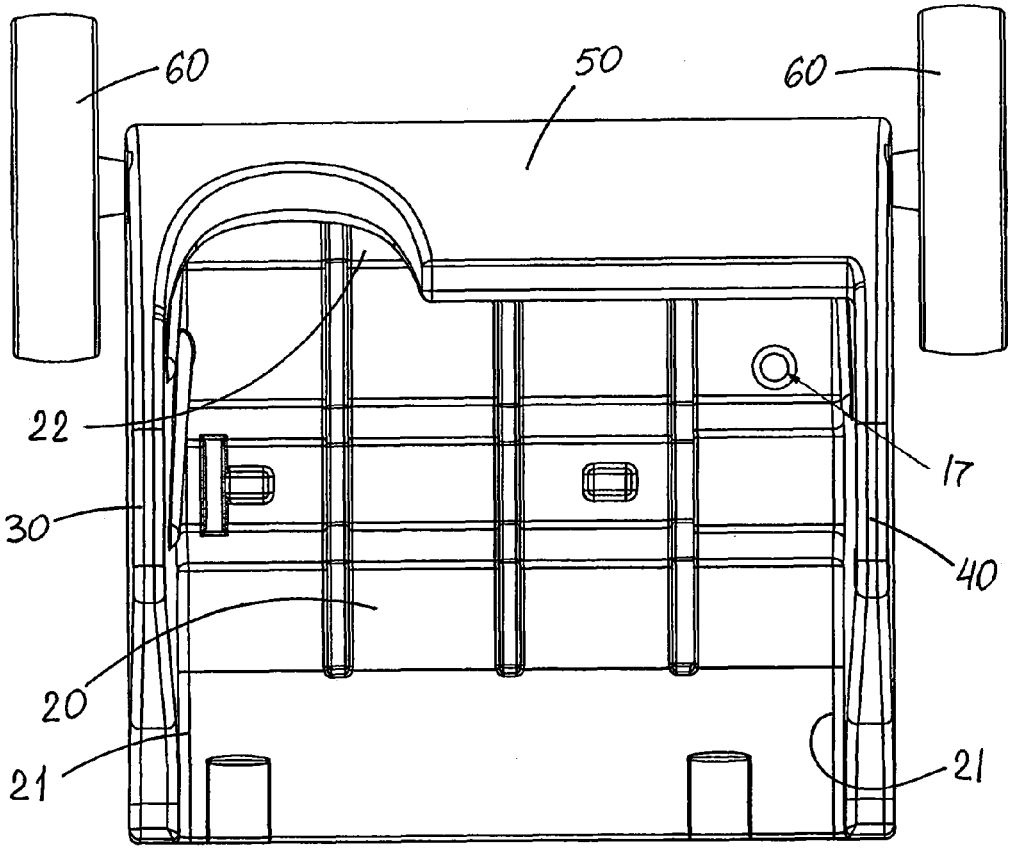
FIG. 3 is a top plan view of the platform.
Figure 4:
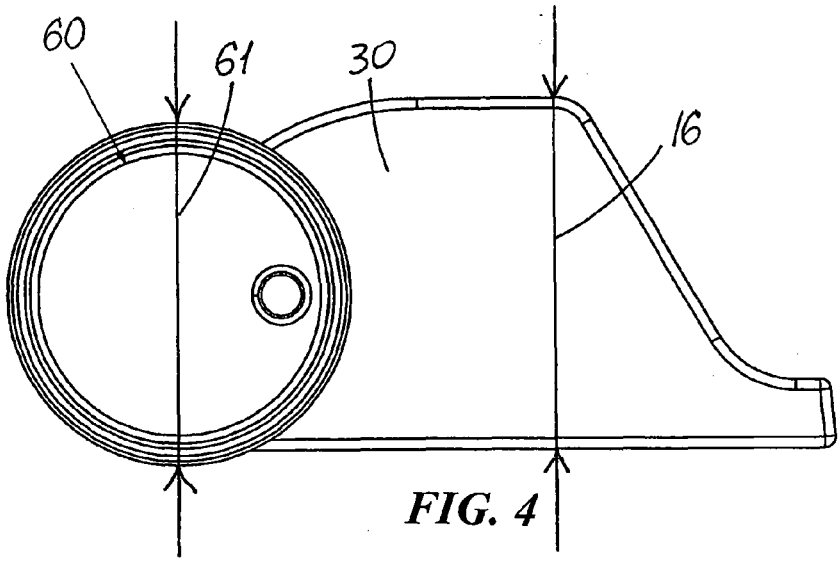
FIG. 4 is a side plan view of the platform.
Figure 5:
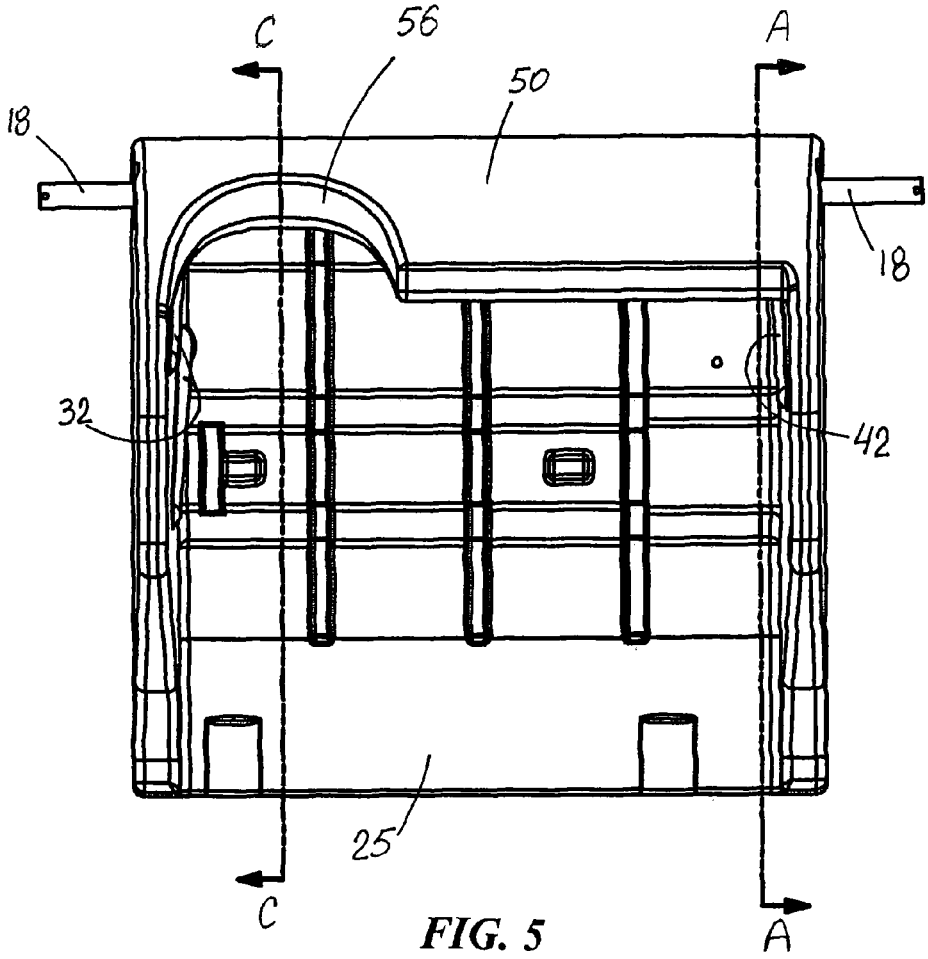
FIG. 5 is a top plan view of the platform of FIG. 3 prior to assembly of wheels and the chock.
Figure 6:
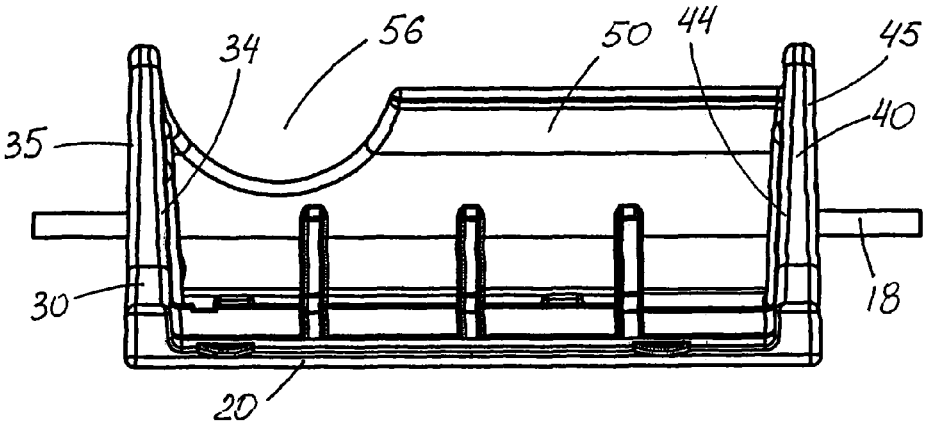
FIG. 6 is a front plan view of the platform as in FIG. 5.

FIGS. 4 and 11 show that pair of wheels 60 have a diameter 61 of about the vertical dimension 16 of platform 10 in resting position. FIG. 3 best shows that each wheel 60 extends alongside corresponding one of sidewalls 30 and 40 and is secured to its corresponding sidewall 30 or 40 by an axle 18 which extends through such sidewall 30 or 40. Such wheel dimensioning facilitates movement of machine 1 on the platform across uneven pavement or even unpaved regions like gravel driveways or outdoor construction areas which may need to be crossed to access a building for carpet cleaning. Compared to prior transport platforms, such greater diameter of the wheels is also advantageous for moving the machine on the platform up and down the stairs.

As best seen in FIGS. 7 and 9, platform base 20, sidewalls 30 and 40 and back wall 50 form an integrally-molded single plastic piece. Axle 18 which may be made of metal is molded in place through sidewalls 30 and 40 during molding of such single plastic piece. This facilitates assembly of platform 10. Both wheels 60 are supported by same axle 18.

It is further seen in FIGS. 7 and 9 that the molded single piece is a hollow structure such that base lower surface 24 and upper surface 23 are separate walls spaced from each other and joined at entry-end 25. Back wall 50 is formed by inner back wall 51 and outer back wall 52 which together define a space 53 therebetween. FIGS. 7 and 9 show axle 18 extending through space 53 within back wall 50. As seen in FIGS. 8 and 10, each sidewall 30 and 40 is formed by an inner wall 34 and 44 spaced from an outer wall 35 and 45, respectively. Inner walls 34 and 44 have inner surfaces 31 and 41 with protrusions 32 and 42.

FIGS. 3, 5, 7 and 9 best show that back wall 50 has an undercut shape 54 formed by inner back wall 51 which conforms to the outer back configuration 5 of machine 1. When machine 1 is positioned on platform 10, undercut shape 54 and outer back configuration 5 are in somewhat mating engagement with each other which further facilitates securement of machine 1 on platform 10. Back wall 50 has an upper edge 55 defining a cutout 56 which receives an outwardly-extending portion 6 of machine back configuration 5, as seen in FIGS. 1, 2 and 11.

Figure 16:
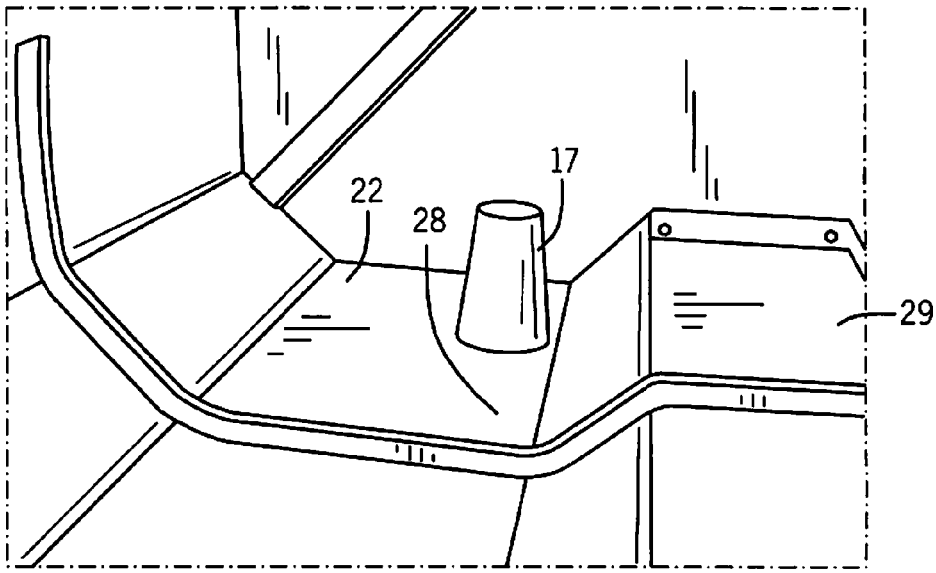
FIG. 16 is a fragmentary perspective view of the platform stowing portion showing the chuck extending therefrom.

Machine 1, as shown in FIGS. 14 and 15 is of the type including brushes 7 with flexible bristles. It is seen in FIGS. 7 and 9 that platform base 20 includes a brush-contact surface 28. FIG. 16 shows a chock 17 extending from stowing portion 26 of platform-base upper surface 23. Chock 17 extends for a sufficient dimension to support machine 1 such that brushes 7 remain above or at upper surface 23. It is also seen in FIGS. 7 and 9 that stowing portion 26 of upper surface 23 includes a ridge 29 which supports machine 1 with brushes 7 above brush-contact surface 28. Chock 17 extends from stowing portion 26 at least to about the level of ridge 29 or higher depending on the construction of machine 1. This prevents significant bending of brush bristles during storage and/or transportation of machine 1.

Figure 19:
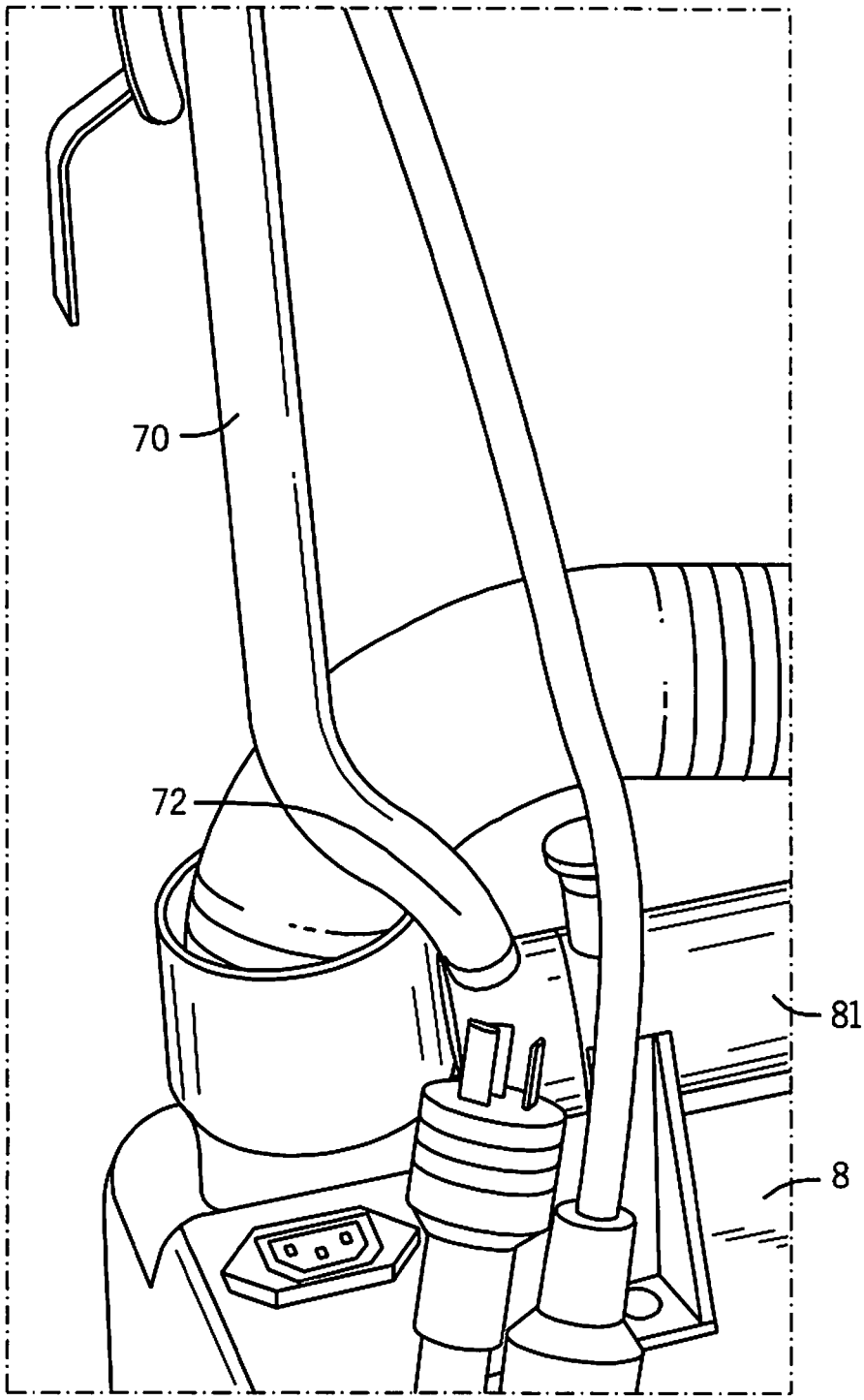
FIG. 19 is a fragmental perspective view of the machine showing an off-set portion of a handle arm.

FIG. 15 best shows that machine 1 has a pair of counter-rotating brushes 7 by which machine 1 is moved along floor 100. As seen in FIG. 1, machine 1 further has a bottom housing 8 over brushes 7. Bottom housing 8 includes first and second side panels 2 and 3, respectively, and a main body 81 therebetween. A top housing 9 is secured over bottom housing 8 and centered over brushes 7. FIG. 19 best shows a handle arm 70 extending upwardly from main body 81 of bottom housing 8 and including an off-set shape 72 to an extent which allows centering of top housing 9 over brushes 7. Such off-set 72 permits positioning of top housing 9 more toward the side of handle arm 70 and in such position over bottom housing 8 that top housing 9 is in the true centered orientation over brushes 7. Due to such centering, a movement path of top housing 9 is aligned with a movement path of brushes 7. And such alignment minimizes side-to-side shifting of moving machine 1.

Figure 12:
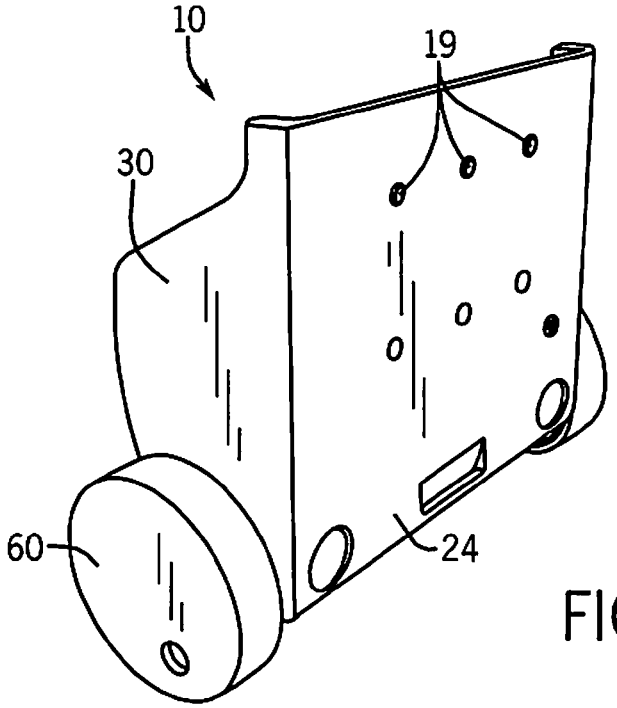
FIG. 12 is a perspective view from below of the platform.
Figure 13:
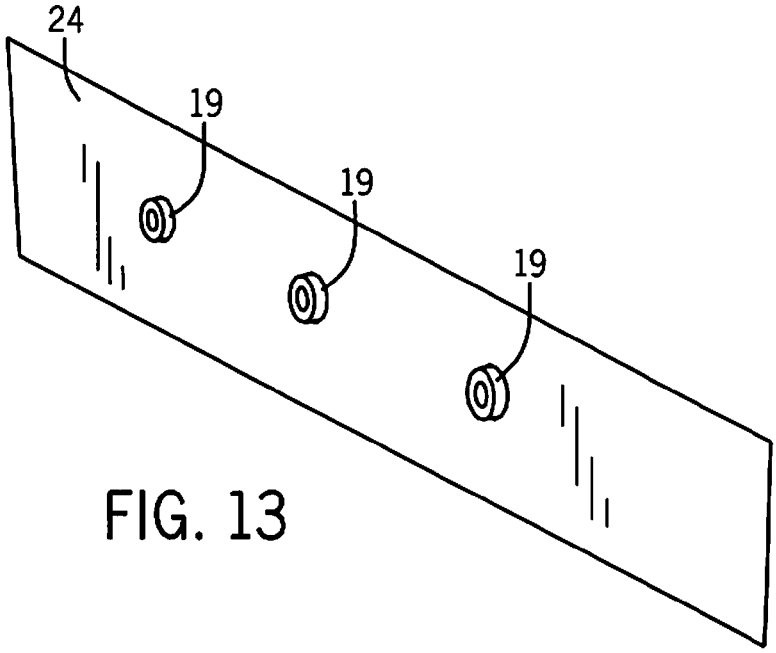
FIG. 13 is a fragmentary perspective view of the platform lower surface showing skid-resisting projections.

FIGS. 12 and 13 show skid-resisting projections 19 extending from lower surface 24 of base 20. Skid-resisting projections 19 facilitate holding of platform 10 from unintended backward rolling during driving of machine 1 onto platform 10 as illustrated in FIGS. 17 and 18. As seen in FIG. 13, skid-resisting projections 19 are rubber pieces secured to lower surface 24. The securement may be by a screw engagement or in any other suitable manner.

While the principles of the invention have been shown and described in connection with specific embodiments, it is to be understood that such embodiments are by way of example and are not limiting.

The invention claimed is:

1. In a combination, a carpet-cleaning machine and a platform for transporting the machine, the machine having first and second side panels, the platform including (a) a machine-supporting base having upper and lower surfaces extending between an open entry-end and a closed back-end, the upper surface having a stowing portion extending from the closed back-end to an entry portion, (b) first and second sidewalls extending upwardly from the base on either side thereof, (c) a back wall extending from the base back-end between the first and second sidewalls, and (d) a pair of wheels mounted with respect to the base for rolling the machine on the platform across a floor, the improvement comprising the first and second platform sidewalls having inner surfaces both shaped with sidewall-portion protrusions frictionally engaging the machine side panels and configured to sandwich the machine therebetween to prevent lateral movement of the machine on the platform.

2. The combination of claim 1 wherein the protrusions of the inner surfaces of the platform sidewalls are elongate protrusions extending in a fore-to-aft direction.

3. The machine of claim 2 wherein the protrusions from the second platform sidewall extend outwardly therefrom progressively more toward the aft ends thereof to facilitate the sandwiching.

4. The machine of claim 3 wherein:

the first platform sidewall defines a pin-receiving opening; and the machine includes a securing pin sliding horizontally from the first side panel for engagement of the pin-receiving opening to restrain vertical movement of the sandwiched machine on the platform.

5. The machine of claim 1 wherein the protrusions from the second platform sidewall extend outwardly therefrom progressively more toward the aft ends thereof to facilitate pressing of the first machine panel against the first platform sidewall to secure the pin-and-opening engagement.

6. The combination of claim 1 wherein the machine has:

a pair of counter-rotating brushes by which the machine is moved along a floor;

a bottom housing over the brushes, the bottom housing including the first and second side panels and a main body therebetween; and a top housing secured over the bottom housing and centered over the brushes, whereby minimizing side-to-side shifting of the machine during use and facilitating riding of the machine onto the platform.

7. The combination of claim 6 wherein a handle arm extends upwardly from the main body of the bottom housing and includes an off-set shape to an extent which allows centering of the top housing over the brushes.

8. In a combination, a carpet-cleaning machine and a platform for transporting the machine, the platform including (i) an integrally-molded single piece having (a) a machine-supporting base with upper and lower surfaces extending between an open entry-end and a closed back-end, (b) first and second sidewalls extending upwardly from the base on either side thereof and (c) a back wall extending from the base back-end between the first and second sidewalls, and (ii) a pair of wheels mounted with respect to the base for rolling the machine on the platform across a floor, the improvement comprising an axle permanently embedded within the walls and extending is through and beyond the sidewalls to support the wheels with respect to the sidewalls and the base.

9. The combination of claim 8 wherein the pair of wheels have a diameter which is substantially the same as the vertical dimension of the platform in resting position.

10. The combination of claim 8 wherein the platform further includes at least one skid-resisting projection extending from the lower surface of the base to facilitate holding of the platform from unintended backward rolling during driving of the machine onto the platform.

11. The combination of claim 10 wherein the platform further includes a plurality of spaced skid-resisting projections.

12. The combination of claim 11 wherein the skid-resisting projections are rubber pieces secured to the lower surface.

13. In a combination, a carpet-cleaning machine and a platform for transporting the machine, the platform including (a) a machine-supporting base having upper and lower surfaces extending between an open entry-end and a closed back-end, (b) first and second sidewalls extending upwardly from the base on either side thereof, (c) a back wall extending from the base back-end between the first and second sidewalls, and (d) a pair of wheels mounted with respect to the base for rolling the machine on the platform across a floor, the improvement comprising the lower surface of the base including at least one skid-resisting projection of higher friction than the lower surface of the base to facilitate holding of the platform from unintended backward rolling during driving of the machine onto the platform.

14. The combination of claim 13 wherein, the upper surface of the entry portion slopes at no more than about 5-degrees with respect to horizontal such that the machine can be driven on and off the platform with application of about same amount of user force as during carpet cleaning operations.

15. The combination of claim 14 wherein:

the machine has first and second side panels; and the inner surfaces of the first and second platform sidewalls both include protrusions frictionally engaging the machine side panels and configured to sandwich the machine therebetween to prevent lateral movement of the machine on the platform.

16. The combination of claim 15 wherein the protrusions of the inner surfaces of the platform sidewalls are elongate protrusions extending in a fore-to-aft direction.

17. The combination of claim 16 wherein the protrusions from the second platform sidewall extend outwardly therefrom progressively more toward the aft ends thereof to facilitate sandwiching of the machine therebetween.

18. The combination of claim 16 wherein:

the first platform sidewall defines a pin-receiving opening; and the machine includes a securing pin sliding horizontally from the first side panel for engagement of the pin-receiving opening to restrain vertical movement of the sandwiched machine on the platform.

19. The combination of claim 18 wherein the protrusions from the second platform sidewall extend outwardly therefrom progressively more toward the aft ends thereof to facilitate pressing of the first machine panel against the first platform sidewall to secure the pin-and-opening engagement.

20. The combination of claim 14 wherein the pair of wheels have a diameter which is substantially the same as the vertical dimension of the platform in resting position.

21. The combination of claim 20 wherein each wheel extends alongside and is secured to a corresponding one of the sidewalls by an axle extending therethrough.

22. The combination of claim 21 wherein:

the platform base, sidewalls and the back wall are integrally molded as a single piece; and the axle is non-movably molded in place through the sidewalls to facilitate assembly of the platform.

23. The combination of claim 14 wherein the back wall of the platform has an undercut shape to conform to the outer back configuration of the machine.

24. The combination of claim 23 wherein the back wall has an upper edge defining a cutout receiving an outwardly-extending portion of the machine back configuration.

25. The combination of claim 14 wherein the machine includes at least one brush having flexible bristles thereon and wherein the base includes:

a brush-contact surface; and a chock extending from the stowing portion of the platform-base upper surface for a sufficient dimension to support the machine such that the brush remains above or at the upper surface in order to prevent significant bending of brush bristles during storage and/or transportation.

26. The combination of claim 14 wherein the machine has:

a pair of counter-rotating brushes by which the machine is moved along a floor;

a bottom housing over the brushes, the bottom housing including first and second side panels and a main body therebetween; and a top housing secured over the bottom housing and centered over the brushes, thereby minimizing side-to-side shifting of the machine during use and facilitating riding of the machine onto the platform.

27. The combination of claim 26 wherein a handle arm extends upwardly from the main body of the bottom housing and includes an off-set shape to an extent which allows centering of the top housing over the brushes.

28. The combination of claim 13 wherein a plurality of spaced skid-resisting projections extend from the lower surface.

29. The combination of claim 28 wherein the skid-resisting projections are rubber pieces secured to the lower surface.

* * * * *

UNITED STATES PATENT AND TRADEMARK OFFICE

CERTIFICATE OF CORRECTION

PATENT NO. : 8,607,411 B2
APPLICATION NO. : 12/828504
DATED : December 17, 2013
INVENTOR(S) : Arthur L. Dominguez et al.

It is certified that error appears in the above-identified patent and that said Letters Patent is hereby corrected as shown below:

In the Claims

In column 7, claim 8, line 38, delete "is".

Signed and Sealed this
Twenty-first Day of April, 2015

Michelle K. Lee

Michelle K. Lee
*Director of the United States Patent and Trademark Office*